US012203339B1

(12) United States Patent
Lenz

(10) Patent No.: US 12,203,339 B1
(45) Date of Patent: Jan. 21, 2025

(54) VALVE SYSTEM FOR A WELLHEAD OF A WELL AND ASSOCIATED METHODS

(71) Applicant: Doug Lenz, Minot, ND (US)

(72) Inventor: Doug Lenz, Minot, ND (US)

( * ) Notice: Subject to any disclaimer, the term of this patent is extended or adjusted under 35 U.S.C. 154(b) by 0 days.

(21) Appl. No.: 18/380,158

(22) Filed: Oct. 13, 2023

(51) Int. Cl.
*E21B 34/02* (2006.01)

(52) U.S. Cl.
CPC ..... *E21B 34/025* (2020.05); *E21B 2200/01* (2020.05)

(58) Field of Classification Search
CPC ..... E21B 34/02; E21B 34/025; E21B 2200/01
See application file for complete search history.

(56) References Cited

U.S. PATENT DOCUMENTS 4,825,945 A * 5/1989 Smith ..... E21B 34/02 166/97.1
2010/0258319 A1* 10/2010 Nguyen ..... E21B 34/02 166/85.1
2017/0009555 A1* 1/2017 Nguyen ..... E21B 34/02
2019/0360292 A1* 11/2019 Boyd ..... E21B 33/03
2020/0248523 A1* 8/2020 Craycraft ..... E21B 33/04
2023/0228167 A1* 7/2023 Pang ..... E21B 34/02 166/250.01

* cited by examiner

*Primary Examiner* — Matthew R Buck
(74) *Attorney, Agent, or Firm* — Robert L Lundstrom

(57) ABSTRACT

A valve system for a wellhead of a well having a Back Pressure Valve (BPV) that is removably disposable in a tubing hanger disposable in a well and a valve tool removably disposed within the BPV. The BPV has a seal surface positioned uphole from an internal thread and a flow chamber positioned uphole from the internal thread and downhole from the sealing surface. The valve tool includes an o-ring groove and o-ring that are selectively positionable to either a closed position where the o-ring groove is adjacent the seal surface disposed in the BPV bore, or the partially open position with the o-ring groove positioned in the flow chamber of the BPV.

10 Claims, 5 Drawing Sheets

VALVE SYSTEM FOR A WELLHEAD OF A WELL AND ASSOCIATED METHODS

BACKGROUND OF THE INVENTION

Field of the Invention

The present invention relates generally to oil wells and wellhead equipment used on oil wells.

Related Art

Oil wells require equipment and tools to manage and control the extraction of oil through the well. A wellhead is installed on the well and secures and seals a tubing hanger that extends into the well bore. A series of valves, piping and tooling, commonly called a Christmas tree, is then installed on the wellhead for managing, servicing and maintaining the wellhead. If a Christmas tree needs to be removed or serviced, a Back Pressure Valve (BPV) is installed that permits removal of the tree while maintaining pressure control of the downhole production tubing. Additionally, a BPV is often used during installation or removal of a blowout preventor that allows working directly over a well. A key feature of the BPV is that it allows one-way downhole flow into the well in the event there is a need to kill the well, but does not allow flow upward from the well.

During the Christmas tree removal and replacement process there is a need to confirm the integrity of the connections of the new equipment to hold pressure. This requires a different type of valve known as a Two-Way Check Valve (TWCV). When new or different equipment has been installed on to the wellhead the TWCV allows the equipment to be pressure tested to industry standards. Unlike the BPV, the TWCV is either open which allows bidirectional flow through the well, or closed which prevents any flow through the well. When the TWCV is closed, the integrity of the equipment above the valve can be pressure tested.

Unfortunately, removing the BPV to install a TWCV usually causes a loss of control of the well during the replacement process since no valve is on the well during the change. This creates a period of time without well control that is unsafe and potentially dangerous for personnel operating in the vicinity of the well.

SUMMARY OF THE INVENTION

The inventor of the present invention has recognized that it would be advantageous to develop a wellhead valve system that couples a Back Pressure Valve (BPV) with a Two-Way Check Valve (TWCV) to minimize unsafe conditions at the wellhead. Additionally, the inventor has recognized that it would be advantageous to develop a valve system that does not required the removal of either the BPV or the TWCV during the installation and pressure check processes of equipment above the wellhead. The inventor has also recognized that it would be beneficial to develop a valve system that can be removed from a wellhead with the same tools that installed and engaged the valve system so as to minimize additional process steps and tooling.

The invention provides a valve system for a wellhead of a well having a Back Pressure Valve (BPV) that can be removably disposable in a tubing hanger disposable in a well. The BPV can have a bore that extends through the BPV from a downhole end to an uphole end. A poppet can be movably disposed within the bore. The poppet can be movable between a one-way flow position and a bidirectional flow position. Flow can be restricted to downward flow through the BPV when the poppet is in the one-way flow position. The poppet can be biased to the one-way flow position. An internal thread in the bore can be positioned uphole from the poppet. A seal surface disposed in the bore can be positioned uphole from the internal thread. A flow chamber can be positioned uphole from the internal thread and downhole from the sealing surface. The flow chamber can have a larger diameter than the internal thread and the sealing surface. The valve system can also have a valve tool removably disposed in the bore of the BPV. The valve tool can be movable within the bore between a fully open position, a partially open position, and a closed position. The valve tool can include a valve body having a downhole end and an uphole end. An external thread can be associated with the downhole end and engageable with the BPV internal thread to lower the valve tool into the BPV when the valve tool is rotated into the internal thread. An o-ring groove sized and shaped to hold an o-ring can be positioned uphole of the external thread. The o-ring groove can be selectively positioned to either the closed position where the o-ring groove is adjacent the seal surface disposed in the BPV bore, or the partially open position with the o-ring groove positioned in the flow chamber of the BPV. An o-ring can be disposed within the o-ring groove such that the o-ring can contact and seal against the seal surface in the BPV when the o-ring groove is in the closed position such that no flow can pass through the valve system. The o-ring can be free of contact with the BPV when the o-ring groove is in the open position in the flow chamber. A relief hole can be disposed in the downhole end of the valve tool. The relief hole can be sized and shaped to receive and engage the poppet in the BPV to selectively move the poppet to the bidirectional flow position such that the valve tool is in the fully open position allowing bidirectional flow through the valve system.

In another aspect, the present invention provides for a valve tool device for a wellhead of a well. The valve tool device can be removably disposable in a bore of a Back Pressure Valve (BPV), and movable to selectively open or close off the BPV from downward flow from above the BPV. The valve tool can have a valve body having a downhole end and an uphole end. An external thread can be associated with the downhole end. The external thread can engage with the BPV to lower the valve tool into the BPV. An o-ring groove sized and shaped to hold an o-ring can be located uphole of the external thread. The o-ring groove can be selectively positionable to a closed position with the o-ring groove adjacent a seal surface disposed in the BPV. An o-ring can be disposed within the o-ring groove such that the o-ring contacts and seals against the seal surface in the BPV when the o-ring groove is in the closed position with no flow allowed past the valve system. The o-ring can be free of contact with the BPV when the o-ring groove is selectively moved further downhole from the BPV seal surface thereby allowing flow past the o-ring.

The present invention also provides for a method for pressure testing a wellhead of a well using a valve system having a Back Pressure Valve (BPV) and a valve tool including the step of setting the BPV in a tubing hanger. The valve tool can be lowered with an installation tool into the tubing hanger to engage the BPV. The valve tool can be rotated until a seal of the valve tool is engaged with a seal surface of the BPV. The installation tool can be removed from the valve tool. The test flange can be installed onto the well head above the BPV and valve tool. The pressures in the well head can be tested via the test flange. The installation tool can be reinstalled onto the valve tool. The valve tool can be lowered with the installation tool until the seal of the valve tool is disengaged from the BPV. The valve tool can be lowered further until a relief hole on a downhole end of the valve tool engages a poppet in the BPV and unseats the poppet allowing any built-up pressure to escape. The valve tool can be rotated further to disengage the BPV from the tubing hanger, and the valve system can be retrieved from the well.

Additional features and advantages of the invention will be apparent from the detailed description which follows, taken in conjunction with the accompanying drawings, which together illustrate, by way of example, features of the invention.

DETAILED DESCRIPTION

Figure 1:
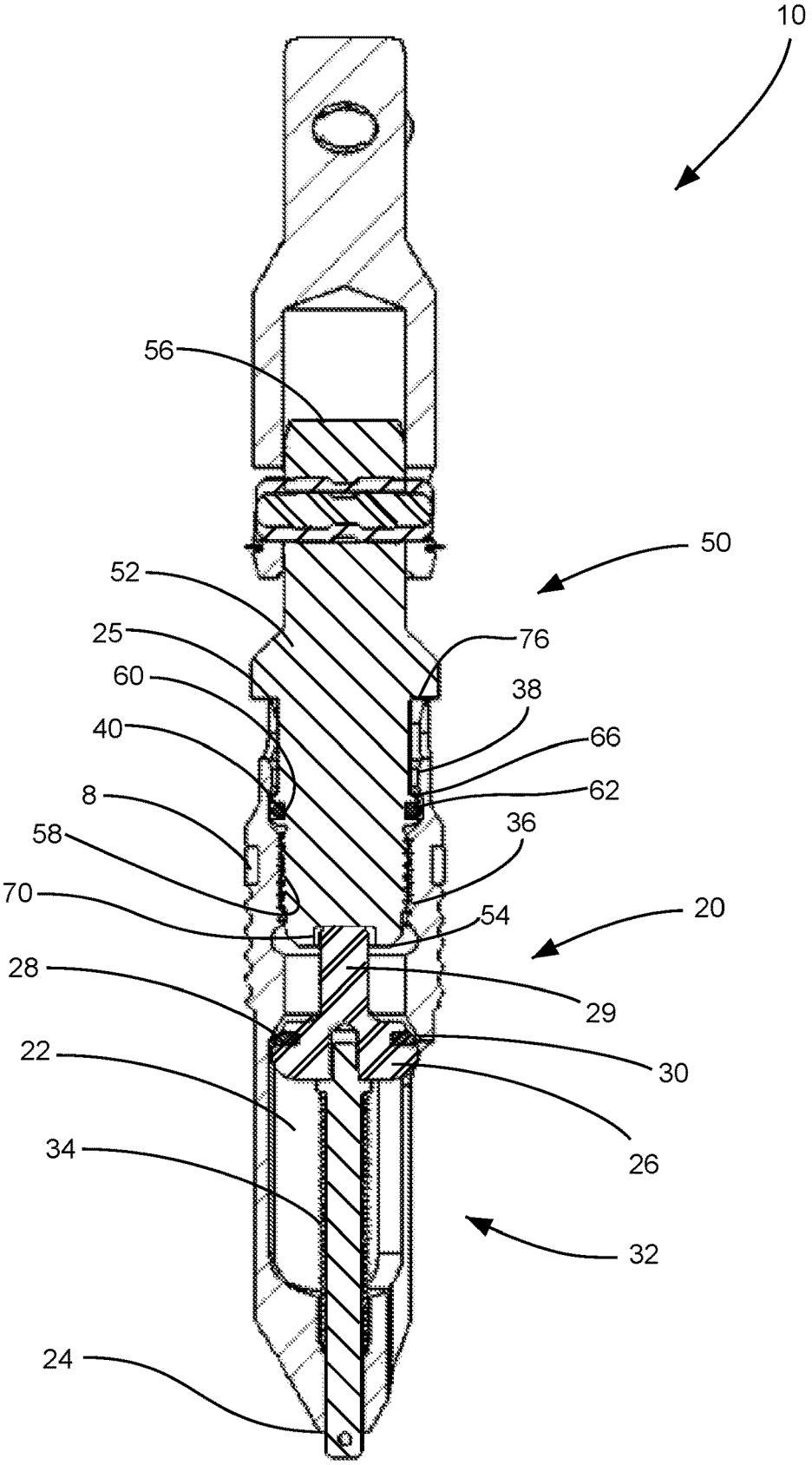
FIG. 1 is a cross section view of a valve system for a wellhead of a well in accordance with an embodiment of the present invention, shown with a valve tool removably disposed in a BPV.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention. For purposes of this detailed description, the term downhole refers to a direction that is down the well bore of the well, and generally means relatively lower or below a referenced feature. Thus, downhole, below, lower and downward are similar in meaning in relation to positioning of features or elements of the present invention. Similarly, the term uphole refers to a direction that is up the well bore of the well, and generally means relatively higher, upward or above a referenced feature or element. Thus, the terms uphole, above, upper, and upward are similar in meaning in relation to positioning of features or elements in the present invention.

The embodiments of the present invention described herein generally provide for a valve system for a wellhead of a well such as an oil well. The valve system can include a Back Pressure Valve (BPV) with a valve tool that can be installed into the BPV with a dry rod and J-tool also known in the art. The valve tool can have an o-ring groove with an o-ring seal that can seal against a sealing surface of the BPV. When the valve tool is positioned such that the o-ring can seal with the BPV, the valve tool can act like a Two-Way Check Valve (TWCV) such that flow through the valve tool is restricted when the valve tool is in a sealed or closed position and flow is unrestricted when the valve tool is in an open position. Advantageously, both the valve tool and the BPV can remain in the tool and function simultaneously so that the BPV need not be removed in order to restrict flow in both directions in the well. This allows pressure testing of equipment and tools connected to the well head without engaging the BPV. When the testing is complete, the valve system can be removed by turning the valve tool to lower the o-ring away from the seal surface thereby allowing pressure to bleed off, and then continuing to lower the valve tool until engagement with the BPV is achieved. Then both the valve tool and the BPV can be removed from the wellhead without the need for attaching any additional removal tooling. Advantageously the process of the present invention eliminates tooling changes and improves efficiency of the pressure testing of uphole equipment and tooling such as a Christmas tree, blow-out preventor, and the like.

As illustrated in FIGS. 1-4, a valve system for a wellhead of a well, indicated generally at 10, is shown in accordance with an embodiment of the present invention for use in selectively restricting flow through the wellhead of the well. The valve system 10 can restrict the flow through the wellhead by being selectively configured in either an open or unrestricted configuration with no impediment to flow through the valve system, a one-way flow configuration with impediments to uphole flow so that only downhole flow can pass through the valve system, or a completely restricted configuration where no flow through the valve system is possible. The valve system 10 can include a Back Pressure Valve (BPV), indicated generally at 20, and a valve tool, indicated generally at 50.

The BPV 20 and the valve tool 50 can work together to selectively configure the valve system 10 to a desired flow configuration. In this way, the BPV and the valve tool can convert the valve system 10 from a fully functional BPV to a fully functional Two-Way Check Valve (TWCV) without having to remove either the BPV or the valve tool from the wellhead. It is a particular advantage of the present invention that the valve system can be configured as either a BPV or a TWCV since both types of valves are needed during the wellhead service and maintenance processes and being able to convert between the two types without having to remove one or the other saves considerable time and resources in addition to being safer for the wellhead and nearby personnel alike.

The BPV 20 can be removably disposable in a tubing hanger, indicated generally at 4, that can be disposed in a well bore (not shown). The BPV can have a tubing hanger seal 8 that can seal the BPV in the tubing hanger. A bore 22 can extend through the BPV from a downhole end 24 disposed relatively lower in the well bore and to an uphole end 25 disposed relatively higher in the well bore.

Advantageously, the valve system 10 can also be installed in the tubing hanger 4 prior to deployment of the tubing hanger in a well and subsequently transported for fit out in a well. In one aspect, the BPV 20 can be installed in the tubing hanger before the tubing hanger is installed in a well. This is advantageous because it allows the valve system to be pressure tested before being deployed to the oil field and installed in a well. It will be appreciated that testing the placement and seal of the BPV in the tubing hanger before the tubing hanger is installed in a well saves time, money and other valuable resources in the field, since it provides an already tested BPV to the well.

Figure 3:
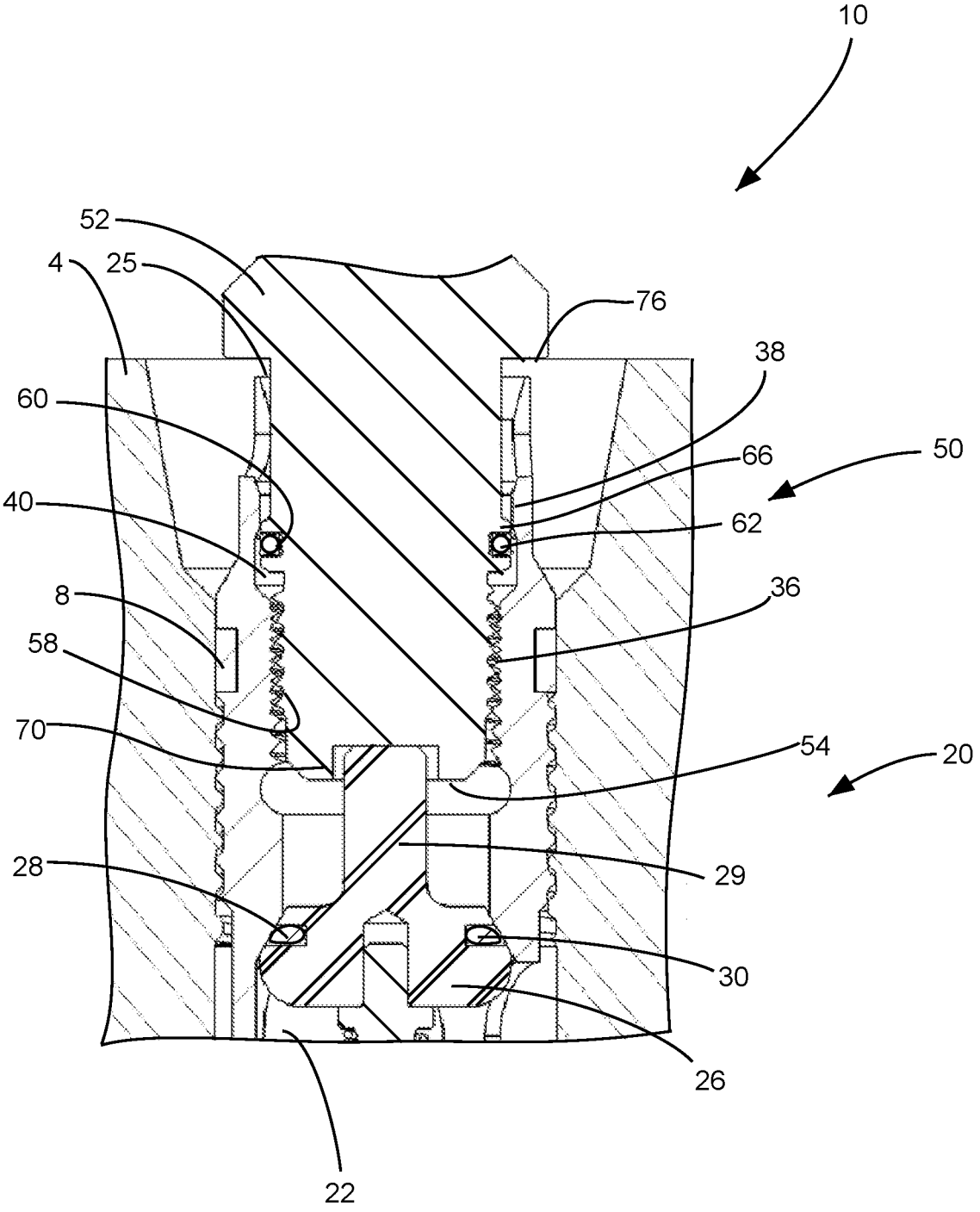
FIG. 3 is a cross section view of the valve system of FIG. 1, shown with the valve tool in a an open position and the BPV in a one-way flow position.
Figure 4:
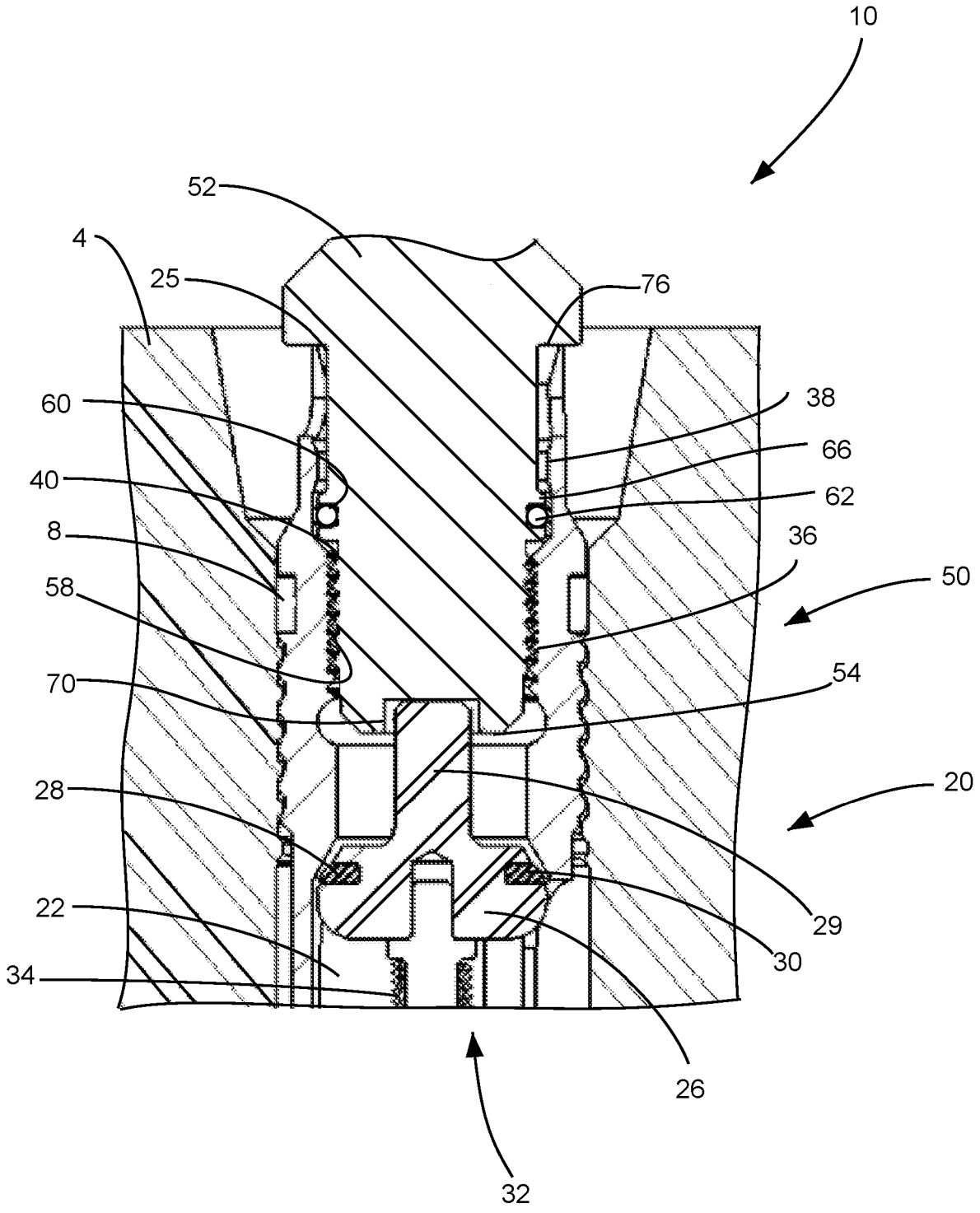
FIG. 4 is a cross section view of the valve system of FIG. 1, shown with the valve tool in a an open position and the BPV in a bidirectional flow position.

A poppet 26 can be movably disposed within the bore 22 of the BPV 20. The poppet can have a poppet seal 28 and a stem 29. The stem can extend upward in an uphole direction away from the poppet seal. The poppet can be movable in the bore between a one-way flow position as best seen in FIG. 3 and a bidirectional flow position as best seen in FIG. 4. When the poppet is in the one-way flow position, the seal 28 on the poppet can seal against a mating sealing surface 30 on the bore of the BPV.

The poppet 26 can be biased to the one-way flow position by a biasing device, indicated generally at 32. In one aspect, the biasing device can be a spring 34 that presses the poppet upward to force the seal 28 onto the sealing surface 30 of the bore 22 of the BPV 20. In this way, fluid flow through the BPV 20 is restricted to downhole flow only provided the fluid has enough pressure to overcome the force of the biasing device and move the poppet away from the sealing surface. Uphole flow from below the poppet can press the poppet against the sealing surface which tightens the seal and prevents flow upward. Hence the BPV can restrict flow to only the downhole direction when the poppet is in the one-way position.

The BPV 20 can also have an internal thread 36. The internal thread can be positioned uphole from the poppet 26. An o-ring seal surface 38 can be disposed in the bore 22 and positioned uphole from the internal thread.

The bore 22 can also have a flow chamber 40. The flow chamber can be positioned uphole from the internal thread 36 and downhole from the o-ring sealing surface 38. The flow chamber can have a relatively larger diameter than the internal thread and the o-ring sealing surface.

With the BPV 20 installed and sealed in the tubing hanger 4, the wellhead tree or other equipment attached to the wellhead can be isolated from the pressure migrating across the BPV from the well cavity (not shown) below the BPV. The wellhead tree or other equipment can then be removed from the wellhead since the BPV isolates and restricts flow upward from the well. In this configuration, with the BPV installed in the hanger tubing, it is possible to pump downhole through the BPV if the well should need to be closed off.

The valve tool 50 can be removably disposable in the bore 22 of the BPV 20. The valve tool can have a valve body 52 having a downhole end 54 and an uphole end 56. The valve tool body 52 can have an external thread 58 associated with the downhole end 54. The external thread can be sized and shaped to engage the internal thread 36 on the BPV 20 when the valve tool 50 is rotated into the internal thread.

The valve tool 50 can have an o-ring groove 60 positioned uphole of the external thread 56. The o-ring groove can be sized and shaped to hold an o-ring 62. In one aspect, the o-ring groove can be associated with a circumferential protrusion 66 on the valve body 52. The protrusion 66 can have a diameter relatively larger than a diameter of the internal threads of the BPV 20 and relatively larger than a diameter of the valve body upward or uphole of the o-ring groove.

The circumferential protrusion 66 provides an advantage to the present invention in that it requires less contact between the valve tool body 52 and the bore 22 of the BPV. It will be appreciated that more contact can lead to greater resistance due to friction and drag, and would thus need more force to move the o-ring groove 60 into a desired position. The circumferential protrusion minimizes the contact between the valve tool body and the bore and thus requires less force to move.

Additionally, having the o-ring 62 and o-ring groove 60 above the external thread 56 of the valve tool 50 can provide an advantage in that it provides a pulling force rather than a pushing force on the o-ring groove and o-ring which can require less overall torque via the threads to move the o-ring groove and o-ring into position. Additionally, having the o-ring groove and o-ring uphole from the threads can reduce sediment and foreign material from the threads to settle on the o-ring which could compromise the sealing ability of the o-ring. Likewise, the o-ring seal can prevent material from falling down in to the threads which could result in the BPV becoming stuck due to foreign material binding in the threads.

Figure 2:
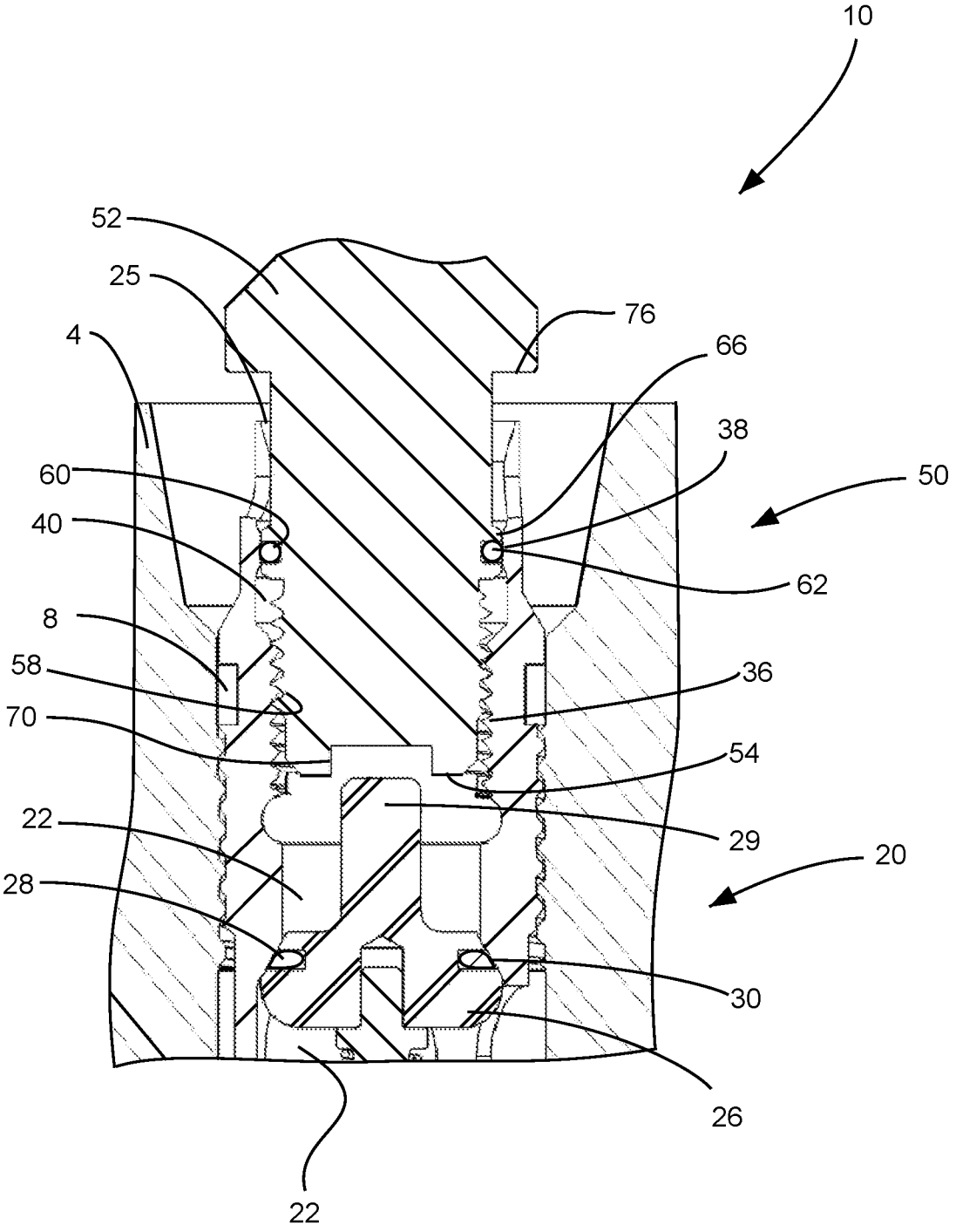
FIG. 2 is a cross section view of the valve system of FIG. 1, shown with the valve tool in a closed position and the BPV in a one-way flow position.

In use, the valve tool 50 can be moved upward and downward within the bore 22 by rotating the external thread 58 on the valve tool into the internal thread 36 of the BPV 20. In this way, the valve tool can be moved between a closed position as best seen in FIG. 2, a partially open position as best seen in FIG. 3, and a fully open position as best seen in FIG. 4. With the valve tool installed migration of pressure in either direction in the well can be restricted and new equipment, such as a well tree or blowout preventer, can be installed and the connections of the equipment to the wellhead can be pressure integrity tested from above.

In the closed position shown in FIG. 2, the o-ring groove 60 and o-ring 62 are positioned adjacent to the sealing surface 38 in the BPV. The o-ring 62 can be disposed within the o-ring groove 60 such that the o-ring can contact and seal against the seal surface 38 of the BPV 20 when the o-ring groove is in the closed position. With the o-ring sealed against the seal surface flow cannot pass through the valve system 10 in either direction.

In the partially open position shown in FIG. 3, the o-ring groove 60 and o-ring 62 are positioned within the flow chamber 40. In this position the o-ring 62 does not contact any surfaces of the BPV and fluid can flow freely past the o-ring. However, while fluid can flow in either direction past the o-ring, flow is still restricted via the poppet 26 in the BPV 20 to downhole flow having sufficient pressure to overcome the biasing device holding the poppet closed. Uphole flow from below the poppet is still restricted by the poppet in the BPV. In this way the valve system 10 of the present invention is in a partially open configuration since fluid can flow but only in one direction through the valve system.

In the fully open position shown in FIG. 4, the o-ring is positioned in the flow chamber 40 of the BPV as described above, but in this position, the valve body 52 has been rotated sufficiently to move the valve body 52 into contact with the stem 29. In one aspect, a relief hole 70 can be disposed in the downhole end 54 of the valve body. The relief hole can be sized and shaped to receive and engage the stem 29 of the poppet 26. With the relief hole engaged with the stem of the poppet, the poppet can be selectively moved in the downhole direction by the valve tool 50 to position the poppet in the bidirectional flow position such that the valve tool 50 is in the fully open position and the poppet is in an open bidirectional flow position thereby allowing bidirectional flow through the valve system 10.

The relief hole 70 can provide an advantage to the valve system 10 of the present invention since it is recessed within the valve tool body 52. This recess lessens the total height or end to end length of the valve system 10, thereby allowing the system of the present invention to be installed below the master valve (not shown) of the well tree (not shown) such that the master valve can be closed with the present invention, or portions thereof, installed in the well tubing hanger 4.

Once the pressure integrity testing of newly installed equipment on the wellhead is complete, the valve system 10 can be retrieved from the well. Hence, the present invention can also have a contact shoulder 76 positioned on the valve body 52 uphole from the o-ring groove 60. The contact shoulder can be sized and shaped to contact the uphole end 25 of the BPV 20 such that the shoulder contacts and stops further downhole movement of the valve tool 50 with the valve tool in the fully open position. In the fully open position, the flow can move in either direction past the valve tool and the poppet 26 in the BPV. In this way, the different sides of the valve system can equalize in pressure from above and below the BPV. With the pressure difference relieved across the BPV, continued torque on the valve tool 50 transmits torque to the body of the BPV resulting in the BPV being threadably removed from the wellhead tubing hanger 4 such that the BPV can be removed from the wellhead.

It will be appreciated that being able to remove the BPV by using the valve tool 50 is a particular advantage to the present invention since the BPV would otherwise require the valve tool to be removed and another tool sent down the wellhead to engage and remove the BPV. Being able to remove the BPV with the valve tool saves time in servicing the wellhead and provides a safer work space since fewer tools and materials are required in the wellhead and fewer trips down the well are needed.

Additionally, if well pressure is noted when the poppet seal 30 disengages from the BPV 20, the valve tool 50 can be reversed until the BPV re-engages the tubing hanger 4 thus putting the well back under control of the BPV until the pressure in the well can be addressed.

Figure 5:
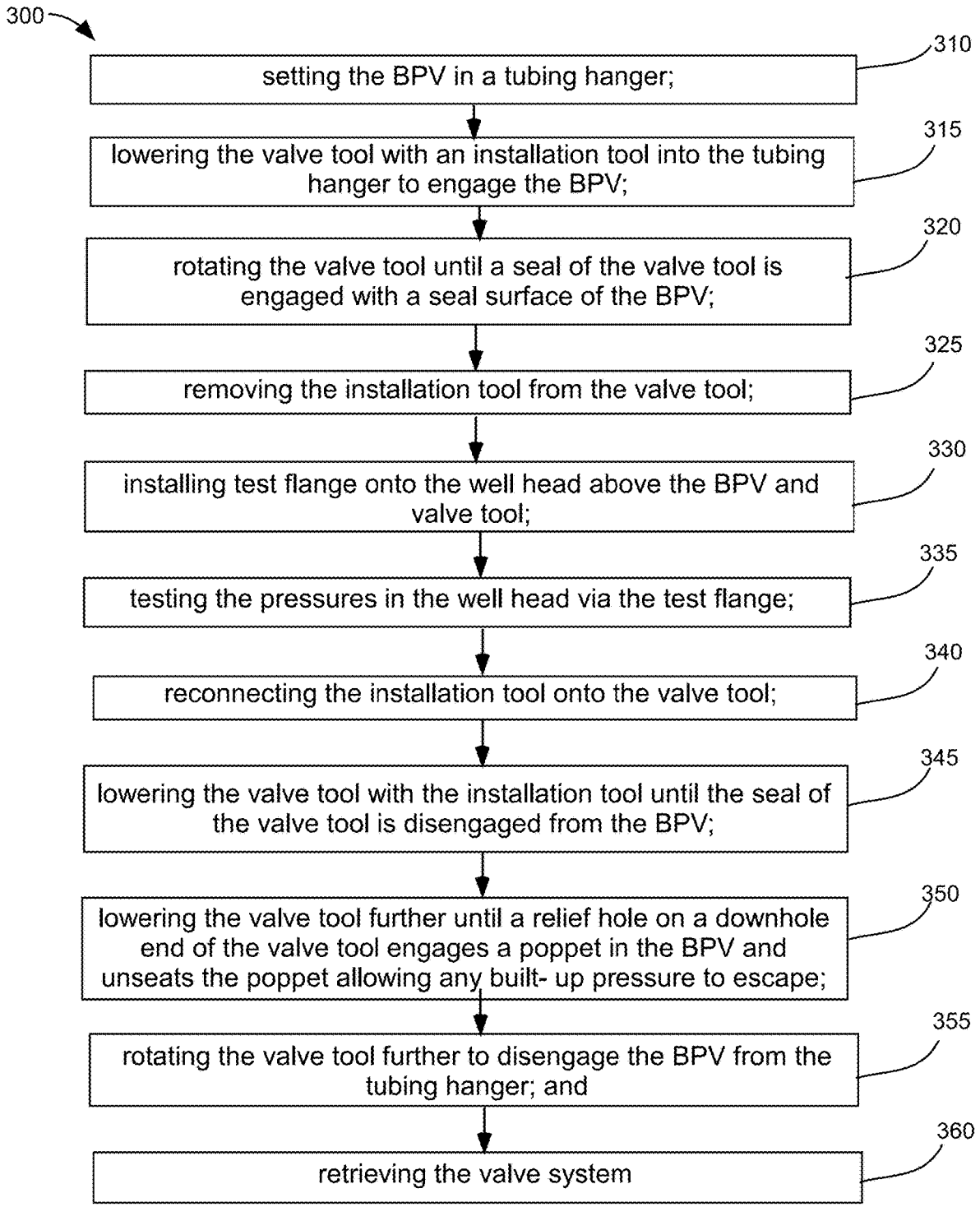
FIG. 5 is a flowchart of a method showing a process for using the valve system of FIG. 1 in a wellhead of a well.

As shown in FIG. 5, the present invention also provides for a method for pressure testing a wellhead of a well using a valve system having a Back Pressure Valve (BPV) and a valve tool, indicated generally at 300, including the step of setting the BPV in a tubing hanger shown at 310. The valve tool can be lowered with an installation tool into the tubing hanger to engage the BPV shown at 315. The valve tool can be rotated until a seal of the valve tool is engaged with a seal surface of the BPV shown at 320. The installation tool can be removed from the valve tool 325.

The test flange can be installed onto the well head above the BPV and valve tool 330. The pressures in the well head can be tested via the test flange 335. The installation tool can be reinstalled onto the valve tool 340. The valve tool can be lowered with the installation tool until the seal of the valve tool is disengaged from the BPV 345. The valve tool can be lowered further until a relief hole on a downhole end of the valve tool engages a poppet in the BPV and unseats the poppet allowing any built-up pressure to escape 350. The valve tool can be rotated further to disengage the BPV from the tubing hanger 355, and the valve system can be retrieved from the well shown at 360.

The step of retrieving the valve testing system includes using the installation tool such that the BPV is removed with the valve tool via the installation tool. The step of testing the pressures includes using test pressures required by industry standards and an have pressures of more than approximately 15,000 psi.

Other benefits of the present invention include being able to use the same standard BPV and TWCV running and retrieving tools when using the BPV in an isolated configuration. Additionally, if the present invention is used as a TWCV then the BPV can be set and left in the hanger for when it is needed later to run the pressure integrity checks of an upper connection. Moreover, the present invention increases well control because the BPV can stay in place throughout nipple down and nipple up operations when well trees and tooling are installed and removed from the wellhead. Furthermore, as previously noted the present invention can reduce the total number of trips required downhole in order to perform service and maintenance on the well. Similarly, this results in a reduced risk to personnel since there are fewer times users are in operating in the dangerous red zones of an oil well. Also, overall, the present invention reduces the risk of a failed TWCV test as the BPV stays in the well with seal integrity maintained.

It is to be understood that the above-referenced arrangements are only illustrative of the application for the principles of the present invention. Numerous modifications and alternative arrangements can be devised without departing from the spirit and scope of the present invention. While the present invention has been shown in the drawings and fully described above with particularity and detail in connection with what is presently deemed to be the most practical and preferred embodiment(s) of the invention, it will be apparent to those of ordinary skill in the art that numerous modifications can be made without departing from the principles and concepts of the invention as set forth herein.

What is claimed is:

1. A valve system for a wellhead of a well, comprising:

a) a Back Pressure Valve (BPV) removably disposable in a tubing hanger disposable in a well, the BPV further comprising:

i) a bore extending through the BPV from a downhole end to an uphole end;

ii) a poppet movably disposed within the bore, the poppet being movable between a one-way flow position and a bidirectional flow position, with flow being restricted to downward flow through the BPV when the poppet is in the one-way flow position, the poppet being biased to the one-way flow position;

iii) an internal thread in the bore positioned uphole from the poppet;

iv) a seal surface disposed in the bore positioned uphole from the internal thread; and v) a flow chamber positioned uphole from the internal thread and downhole from the seal surface, the flow chamber having a larger diameter than the internal thread and the seal surface; and b) a valve tool removably disposable in the bore of the BPV, and movable within the bore between a fully open position, a partially open position, and a closed position, the valve tool further comprising:

i) a valve body having a downhole end and an uphole end;

ii) an external thread associated with the downhole end and engageable with the BPV internal thread to lower the valve tool into the BPV when the valve tool is rotated into the internal thread;

iii) an o-ring groove sized and shaped to hold an o-ring, and positioned uphole of the external thread, the o-ring groove selectively positionable to the closed position with the o-ring groove adjacent the seal surface disposed in the BPV bore, and the partially open position with the o-ring groove positioned in the flow chamber of the BPV;

iv) an o-ring disposed within the o-ring groove such that the o-ring contacts and seals against the seal surface in the BPV when the o-ring groove is in the closed position with no flow past the valve system, and the o-ring is free of contact with the BPV when the o-ring groove is in the open position in the flow chamber; and v) a relief hole disposed in the downhole end and sized and shaped to receive and engage the poppet to selectively move the poppet to the bidirectional flow position such that the valve tool is in the fully open position allowing bidirectional flow through the valve system.

2. The system of claim 1, further comprising:

a contact shoulder positioned on the valve body uphole of the o-ring groove, the contact shoulder sized and shaped to contact the uphole end of the BPV such that the shoulder contacts and stops further downhole movement of the valve tool with the valve tool in the fully open position.

3. The system of claim 1, wherein the valve system is installable in the tubing hanger prior to deployment in a well and subsequently transported for fit out in a well.

4. The system of claim 1, wherein the valve system is pressure testable in the tubing hanger prior to installation in a well.

5. The system of claim 1, wherein the valve system is capable of stopping pressures greater than approximately 15,000 psi.

6. The system of claim 1, wherein the valve system allows flow in the downhole direction when the valve tool is in the partially open position.

7. The system of claim 1, wherein the o-ring groove is associated with a circumferential protrusion having a diameter larger than a diameter of the internal threads of the BPV and larger than a diameter of the valve body uphole of the o-ring groove.

8. The system of claim 1, the poppet further comprising:

a) a seal on the poppet that engages a mating seal surface of the bore of the BPV; and b) a stem extending uphole from the seal, and sized, shaped and positioned to interface with the relief hole in the valve body.

9. The system of claim 1, the poppet further comprising a spring that biases the poppet to the one-way flow position.

10. The system of claim 9, wherein the biasing device is a spring positioned between the poppet and the BPV bore and pressing the poppet against the BPV bore.

* * * * *